US009896978B2

(12) United States Patent
Lee et al.

(10) Patent No.: US 9,896,978 B2
(45) Date of Patent: Feb. 20, 2018

(54) INTAKE VALVE FOR ENGINE

(71) Applicant: Hyundai Motor Company, Seoul (KR)

(72) Inventors: Seungwoo Lee, Seoul (KR); Jiho Kim, Seoul (KR); Hongkil Baek, Seoul (KR); Jiyoun Seo, Gyeonggi-do (KR); Dongkyu Lee, Gyeonggi-Do (KR); Bokyung Kim, Gyeonggi-Do (KR); Inwoong Lyo, Gyeonggi-Do (KR); Minkyu Park, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 58 days.

(21) Appl. No.: 14/551,036

(22) Filed: Nov. 23, 2014

(65) Prior Publication Data

US 2015/0308303 A1 Oct. 29, 2015

(30) Foreign Application Priority Data

Apr. 29, 2014 (KR) ..... 10-2014-0051621

(51) Int. Cl.

| | |
|---|---|
| ***F01L 3/02*** | (2006.01) |
| ***F01L 3/04*** | (2006.01) |
| ***F01L 3/20*** | (2006.01) |
| *F01L 3/22* | (2006.01) |
| *F01L 3/14* | (2006.01) |

(52) U.S. Cl.

CPC ..... *F01L 3/04* (2013.01); *F01L 3/20* (2013.01); *F01L 3/02* (2013.01); *F01L 3/14* (2013.01); *F01L 3/22* (2013.01)

(58) Field of Classification Search

CPC ..... F01L 3/02; F01L 3/04; F01L 3/20; F01L 3/14; F01L 3/22

USPC ..... 123/188.3

See application file for complete search history.

(56) References Cited

U.S. PATENT DOCUMENTS

| | | | | |
|---|---|---|---|---|
| 4,796,572 | A * | 1/1989 | Heydrich | F01P 9/00 123/193.2 |
| 2002/0062983 | A1* | 5/2002 | Mesaki | C09D 167/00 174/120 R |
| 2003/0084891 | A1* | 5/2003 | Gillston | F02B 51/02 123/670 |
| 2006/0189736 | A1* | 8/2006 | Mori | C08L 101/10 524/404 |
| 2011/0265977 | A1* | 11/2011 | Iwaoka | B41M 5/423 165/135 |
| 2012/0088855 | A1* | 4/2012 | Gawryla | B01J 13/0091 521/91 |

FOREIGN PATENT DOCUMENTS

| | | | |
|---|---|---|---|
| CN | 102690656 | A * | 9/2012 |
| JP | 2003-307105 | A | 10/2003 |
| JP | 2005-179514 | A | 7/2005 |

* cited by examiner

*Primary Examiner* — Jacob Amick
*Assistant Examiner* — Charles Brauch
(74) *Attorney, Agent, or Firm* — Mintz Levin Cohn Ferris Glovsky and Popeo, P.C.; Peter F. Corless

(57) ABSTRACT

An intake valve for an engine supplies an intake gas to a combustion chamber of the engine, and an adiabatic coating layer including a polyamideimide resin and an aerogel dispersed in the polyamideimide resin and having thermal conductivity of 0.60 W/m or less may be formed on a surface portion that comes into contact with a flame during operation of the engine.

9 Claims, 3 Drawing Sheets

INTAKE VALVE FOR ENGINE

CROSS-REFERENCE TO RELATED APPLICATION

This application claims under 35 U.S.C. § 119(a) priority to and the benefit of Korean Patent Application No. 10-2014-0051621 filed in the Korean Intellectual Property Office on Apr. 29, 2014, the entire contents of which are incorporated herein by reference.

BACKGROUND (a) Field of the Invention

The present invention relates to an engine for a vehicle, and more particularly, to an intake valve supplying an intake gas to a combustion chamber of the engine.

(b) Description of the Related Art

Generally, an internal combustion engine refers to an engine where a fuel gas generated by combusting fuel directly is applied to a piston, a turbine blade, or the like to convert heat energy of the fuel into mechanical work.

In many cases, the internal combustion engine refers to a reciprocal motion type engine which ignites a mixture gas of the fuel and air in a cylinder to cause an explosion and thus moves a piston, but a gas turbine, a jet engine, a rocket engine, and the like can also be the internal combustion engine.

The internal combustion engine is classified into a gas (or gasoline) engine, a petroleum engine, a diesel engine, and the like depending on the fuel that is consumed. In particular, petroleum, gas, and gasoline engines cause ignition as an electric flame by a spark plug, and the diesel engine sprays the fuel into air at high temperatures and high pressure to cause spontaneous ignition. The engine may utilize a four stroke cycle method or a two stroke cycle method according to a stroke and an operation of the piston.

Typically, it is known that the internal combustion engine of a vehicle has heat efficiency of about 15% to 35%, but about 60% or more of total heat energy is consumed due to heat energy and an exhaust gas emitted to the outside through a wall of the internal combustion engine, even at maximum efficiency of the internal combustion engine.

As described above, if a quantity of heat energy emitted to the outside through the wall of the internal combustion engine is reduced, efficiency of the internal combustion engine may be increased, and therefore methods of installing an adiabatic material outside of the internal combustion engine, changing a portion of a material or a structure of the internal combustion engine, or developing a cooling system of the internal combustion engine are used.

Particularly, if emission of heat generated in the internal combustion engine along the wall of the internal combustion engine to the outside is minimized, efficiency of the internal combustion engine and fuel efficiency of the vehicle may be improved, but research on an adiabatic material, an adiabatic structure, or the like, which may be maintained over a long period of time in the internal combustion engine to which a repeated high temperature and high pressure condition is applied, has not been fully developed.

The above information disclosed in this Background section is only for enhancement of understanding of the background of the invention and therefore it may contain information that does not form the prior art that is already known in this country to a person of ordinary skill in the art.

The above information disclosed in this Background section is only for enhancement of understanding of the background of the invention and therefore it may contain information that does not form the prior art that is already known in this country to a person of ordinary skill in the art.

SUMMARY

The present invention provides an intake valve for an engine, which is capable of blocking heat absorption, promoting a reduction in cooling loss (heat loss) by an adiabatic effect, and improving efficiency of the engine and fuel efficiency of a vehicle by applying an adiabatic coating layer capable of securing high mechanical properties and heat resistance while having low thermal conductivity and a low volumetric heat capacity.

An exemplary embodiment of the present invention provides an intake valve for an engine, which supplies an intake gas to a combustion chamber of the engine, in which an adiabatic coating layer including a polyamideimide resin and an aerogel dispersed in the polyamideimide resin and having thermal conductivity of 0.60 W/m or less is formed on a surface portion that is configured to come into contact with a flame during operation of the engine.

Another exemplary embodiment of the present invention provides an intake valve for an engine, which supplies an intake gas to a combustion chamber of the engine, in which an adiabatic coating layer including a polyamideimide resin and an aerogel dispersed in the polyamideimide resin and having thermal conductivity of 0.60 W/m or less is formed on a neck portion that is configured to come into contact with the intake gas.

Yet another exemplary embodiment of the present invention provides an intake valve for an engine, which supplies an intake gas to a combustion chamber of the engine, in which an adiabatic coating layer including a polyamideimide resin and an aerogel dispersed in the polyamideimide resin and having thermal conductivity of 0.60 W/m or less is formed on a surface portion that is configured to come into contact with a flame and a neck portion that is configured to come into contact with the intake gas.

In the intake valve for the engine according to the exemplary embodiment of the present invention, the adiabatic coating layer may have a thermal capacity of 1,250 $KJ/m^3$ K or less.

In the intake valve for the engine according to the exemplary embodiment of the present invention, the polyamideimide resin may exist in a content of 2 wt % or less in the aerogel.

In the intake valve for the engine according to the exemplary embodiment of the present invention, the polyamideimide resin may not exist at a depth corresponding to 5% or more of a longest diameter from a surface of the aerogel.

In the intake valve for the engine according to the exemplary embodiment of the present invention, each aerogel may have porosity of 92% to 99% while being dispersed in the polyamideimide resin.

In the intake valve for the engine according to the exemplary embodiment of the present invention, the adiabatic coating layer may have a thickness of 50 μm to 500 μm.

In the intake valve for the engine according to the exemplary embodiment of the present invention, the adiabatic coating layer may include 5 to 50 parts by weight of the aerogel based on 100 parts by weight of the polyamideimide resin.

According to the exemplary embodiments of the present invention, it is possible to block heat absorption, promote a reduction in cooling loss (heat loss) by an adiabatic effect, and improve efficiency of an engine and fuel efficiency of a vehicle by applying an adiabatic coating layer capable of securing high mechanical properties and heat resistance while having low thermal conductivity and a low volumetric heat capacity.

BRIEF DESCRIPTION OF THE DRAWINGS

These drawings are referred to illustrate exemplary embodiments of the present invention, and thus the technical spirit of the present invention should not be construed to be limited to the accompanying drawings.

DETAILED DESCRIPTION OF THE EMBODIMENTS

Figure 1:
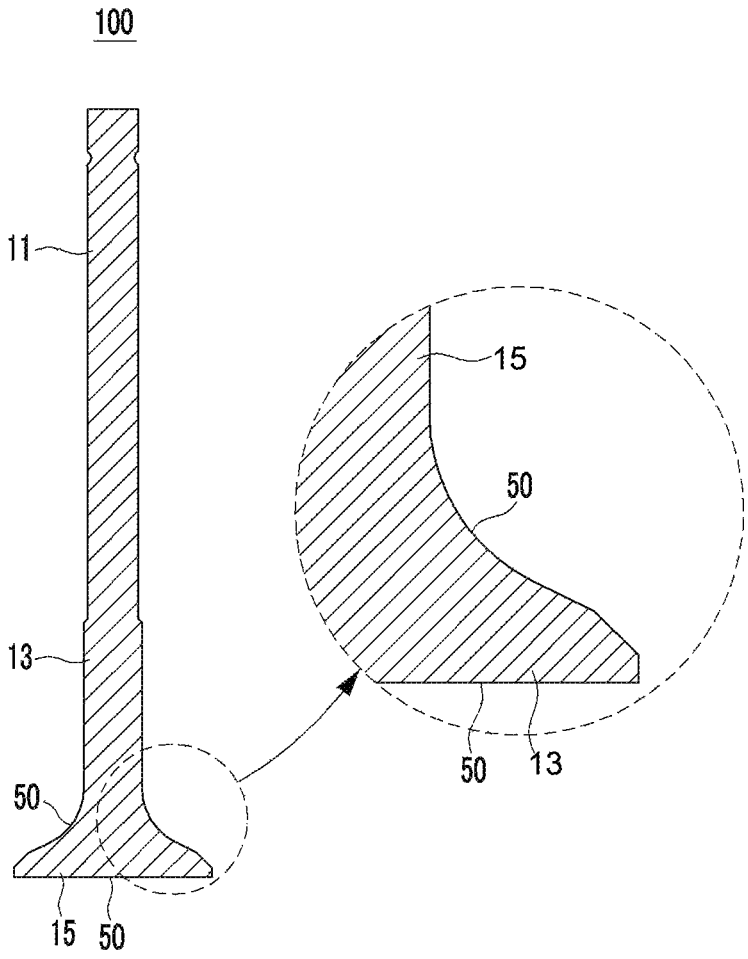
FIG. 1 is a view schematically illustrating an intake valve for an engine according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

A part irrelevant to the description will be omitted to clearly describe the present invention, and the same elements will be designated by the same reference numerals throughout the specification. The size and thickness of each configuration shown in the drawings are arbitrarily shown for understanding and ease of description, but the present invention is not limited thereto, and the thicknesses of portions and regions are exaggerated for clarity.

In addition, in the following detailed description, names of constitutions are classified into first and second matters in order to classify the constitutions because the constitutions are identical with each other, but the constitutions are not limited to the order thereof in the following description.

In addition, the terms "... unit", "... means", "... part", and "... member" described in the specification mean a unit of a comprehensive constitution for performing at least one function or operation.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

FIG. 1 is a view schematically illustrating an intake valve for an engine according to an exemplary embodiment of the present invention. Referring to FIG. 1, an intake valve 100 for an engine may be applied to a vehicle, where the engine ignites and explodes a mixture gas of a fuel and air in a combustion chamber of a cylinder to move a piston.

The intake valve 100 for the engine is configured to supply an intake gas to the combustion chamber of the cylinder, and includes a stem portion 11, a face portion 13, and a neck portion 15.

Herein, the stem portion 11 may be defined as a portion configured to come into contact with a valve guide and the like, the face portion 13 may be defined as a portion configured to come into contact with a flame of the combustion chamber, and the neck portion 15 may be defined as a portion configured to come into contact with the stem portion 11 and the face portion 13 and configured to come into contact with the intake gas.

Hereinafter, according to the exemplary embodiment of the present invention, application of the intake valve 100 to an engine of a vehicle will be described as an example, but it should be understood that the scope of the present invention is not essentially limited thereto, and as long as the intake valve is an intake valve adopted in various kinds of internal combustion engines for the various purposes, such as a gas turbine, a jet engine, and a rocket, the technical spirit of the present invention may be applied thereto.

The intake valve 100 for the engine according to the exemplary embodiment of the present invention has a structure which is capable of blocking heat absorption, promoting a reduction in cooling loss (heat loss) by an adiabatic effect, and improving efficiency of the engine and fuel efficiency of the vehicle by applying an adiabatic coating layer capable of securing high mechanical properties and heat resistance while having low thermal conductivity and a low volumetric heat capacity.

To this end, in the intake valve 100 for the engine according to the exemplary embodiment of the present invention, an adiabatic coating layer 50 is formed on the face portion 13 configured to come into contact with the flame. In particular, the adiabatic coating layer 50 is a bottom surface of the valve, and may be formed on the face portion 13 configured to come into contact with the flame of the combustion chamber of the cylinder.

Moreover, in the intake valve 100 for the engine according to the exemplary embodiment of the present invention, the adiabatic coating layer 50 is formed on the neck portion 15 configured to come into contact with the intake gas.

Herein, the adiabatic coating layer 50 may be formed on any one of the face portion 13 and the neck portion 15, and may be formed on both the face portion 13 and the neck portion 15.

Hereinafter, the adiabatic coating layer 50 applied to the intake valve 100 for the engine, and an adiabatic coating composition thereof will be described in more detail.

The exemplary embodiment of the present invention provides the adiabatic coating composition including a polyamideimide resin dispersed in a high boiling point organic solvent or an aqueous solvent and an aerogel dispersed in a low boiling point organic solvent as the adiabatic coating layer.

Further, the adiabatic coating layer according to the exemplary embodiment of the present invention includes the polyamideimide resin and the aerogel dispersed in the polyamideimide resin, and has thermal conductivity of 0.60 W/m or less.

According to the specific exemplary embodiment of the present invention, the adiabatic coating composition including the polyamideimide resin dispersed in the high boiling point organic solvent or the aqueous solvent and the aerogel dispersed in the low boiling point organic solvent may be provided.

It was confirmed through an experiment that the coating composition obtained by dispersing the polyamideimide resin and the aerogel in predetermined solvents, respectively, and then mixing the resultant solutions, and the coating layer obtained therefrom could secure high mechanical properties and heat resistance while having low thermal conductivity and low density, and was applied to the internal combustion engine to reduce heat energy emitted to the outside and thus improve efficiency of the internal combustion engine and fuel efficiency of the vehicle, thereby accomplishing the invention.

Methods of using an aerogel (or air-gel) have been introduced in fields such as an adiabatic material, an impact absorber, and a soundproofing material. For example, the aerogel has a structure in which microfilaments having a thickness that is a ten-thousandth of that of hair are entangled, and has porosity of 90% or more, and main materials thereof are silicon oxide, carbon, or an organic polymer. Particularly, the aerogel is an ultra-low density material having high permeableness and ultra-low thermal conductivity due to the aforementioned structural characteristic.

However, since the aerogel is easily broken even by small impact due to high brittleness to exhibit very poor strength and it is difficult to process the aerogel to have various thicknesses and shapes, there is a predetermined limitation in application to the adiabatic material even though the aerogel has an excellent adiabatic characteristic, and in the case where the aerogel and the other reactants are mixed, there are problems in that since a solvent or a solute permeates an inside of the aerogel to increase viscosity of a compound and thus make mixing unfeasible, it is difficult to perform complexation of the aerogel with the other material or mix the aerogel with the other material, and a characteristic of the porous aerogel is not exhibited.

On the other hand, in the adiabatic coating composition of the exemplary embodiment, the polyamideimide resin exists while being dispersed in the high boiling point organic solvent or aqueous solvent and the aerogel exists while being dispersed in the low boiling point organic solvent, and thus a solvent dispersion phase of the polyamideimide resin and a solvent dispersion phase of the aerogel do not agglomerate but may be uniformly mixed, and the adiabatic coating composition may also have a homogeneous composition.

Moreover, since the high boiling point organic solvent or aqueous solvent and the low boiling point organic solvent are not easily mutually dissolved or mixed, the polyamideimide resin and the aerogel are mixed while the polyamideimide resin is dispersed in the high boiling point organic solvent or aqueous solvent and the aerogel is dispersed in the low boiling point organic solvent, to form the coating composition, and thus direct contact between the polyamideimide resin and the aerogel may be minimized before the adiabatic coating composition of the exemplary embodiment is applied and dried, and the polyamideimide resin may be prevented from permeating the inside of the aerogel or the pore or being impregnated in the aerogel or the pore.

Further, since the low boiling point organic solvent has predetermined affinity with the high boiling point organic solvent or aqueous solvent, the low boiling point organic solvent may serve to materially mix the aerogel dispersed in the low boiling point organic solvent and the polyamideimide resin dispersed in the high boiling point organic solvent or aqueous solvent and thus uniformly distribute the aerogel and uniformly distribute the polyamideimide resin in the high boiling point organic solvent or aqueous solvent.

Accordingly, in the adiabatic coating layer obtained from the adiabatic coating composition of the exemplary embodiment, physical properties of the aerogel may be secured at the same level or more, and the aerogel may be more uniformly dispersed in the polyamideimide resin to implement improved adiabatic characteristics together with high mechanical properties and heat resistance.

In particular, as described above, in the adiabatic coating layer obtained from the adiabatic coating composition of the exemplary embodiment, since the physical properties and the structure of the aerogel may be maintained at the same level, the adiabatic coating layer may secure high mechanical properties and heat resistance while having low thermal conductivity and low density, and may be applied to the internal combustion engine to reduce heat energy emitted to the outside and thus improve efficiency of the internal combustion engine and fuel efficiency of the vehicle.

Herein, the adiabatic coating layer, as illustrated in FIG. 1, may be applied to the face portion 13 configured to come into contact with the flame of the combustion chamber, the neck portion 15 configured to come into contact with the intake gas, and both the face portion 13 and the neck portion 15.

Meanwhile, the adiabatic coating composition of the exemplary embodiment may be formed by mixing the polyamideimide resin dispersed in the high boiling point organic solvent or aqueous solvent and the aerogel dispersed in the low boiling point organic solvent as described above.

The mixing method is not limited, and any typically known physical mixing method may be used. For example, there is a method of manufacturing a coating composition (coating solution) by mixing two kinds of solvent dispersion phases, adding a zirconia bead thereto, and performing ball milling under a condition of a temperature of room temperature and normal pressure at a speed of 100 to 500 rpm. However, the method of mixing the solvent dispersion phases of the polyamideimide resin and the aerogel is not limited to the aforementioned example.

The adiabatic coating composition of the exemplary embodiment may provide the adiabatic material, an adiabatic structure, and the like, which may be maintained over a long period of time in the internal combustion engine to which a repeated high temperature and high pressure condition is applied, and specifically, the adiabatic coating composition of the exemplary embodiment may be used in coating of an internal surface of the internal combustion engine or parts of the internal combustion engine, and further, as described above, may be used in coating of the face portion and/or the neck portion of the intake valve.

An example of the polyamideimide resin, which may be included in the adiabatic coating composition of the exemplary embodiment, is not largely limited, but the polyamideimide resin may have a weight average molecular weight of 3,000 to 300,000, or 4,000 to 100,000.

If the weight average molecular weight of the polyamideimide resin is very small, it may be difficult to sufficiently secure mechanical properties, heat resistance, and an adiabatic property of a coating layer, a coating film, or a coating membrane obtained from the adiabatic coating composition, and a polymer resin may easily permeate the inside of the aerogel.

Further, if the weight average molecular weight of the polyamideimide resin is very large, uniformity or homogeneity of the coating layer, the coating film, or the coating membrane obtained from the adiabatic coating composition may deteriorate, dispersibility of the aerogel in the adiabatic coating composition may be reduced or a nozzle and the like of a coating device may be clogged when the adiabatic coating composition is applied, a heat-treating time of the adiabatic coating composition may be prolonged, and a heat-treating temperature may be increased.

A typical aerogel known in the art may be used as the aforementioned aerogel, and specifically, the aerogel of components including silicon oxide, carbon, polyimide, metal carbide, or a mixture of two or more kinds thereof may be used. The aerogel may have a specific surface area of 100 $cm^3/g$ to 1,000 $cm^3/g$, or 300 $cm^3/g$ to 900 $cm^3/g$.

The adiabatic coating composition may include the aerogel in a content of 5 to 50 parts by weight or 10 to 45 parts by weight based on 100 parts by weight of the polyamideimide resin. A weight ratio of the polyamideimide resin and the aerogel is a weight ratio of solids other than the dispersion solvent.

If the content of the aerogel based on the polyamideimide resin is very small, it may be difficult to reduce thermal conductivity and density of the coating layer, the coating film, or the coating membrane obtained from the adiabatic coating composition, it may be difficult to secure a sufficient adiabatic property, and heat resistance of the adiabatic membrane manufactured from the adiabatic coating composition may be reduced.

Further, if the content of the aerogel based on the polymer resin is very large, it may be difficult to sufficiently secure mechanical properties of the coating layer, the coating film, or the coating membrane obtained from the adiabatic coating composition, cracks may be generated in an adiabatic membrane manufactured from the adiabatic coating composition, or it may be difficult to maintain a strong coat form of the adiabatic membrane.

The solid content of the polyamideimide resin in the high boiling point organic solvent or aqueous solvent is not largely limited, but the solid content may be 5 wt % to 75 wt % in consideration of uniformity or physical properties of the adiabatic coating composition.

Further, the solid content of the aerogel in the low boiling point organic solvent is not largely limited, but the solid content may be 5 wt % to 75 wt % in consideration of uniformity or physical properties of the adiabatic coating composition.

As described above, since the high boiling point organic solvent or aqueous solvent and the low boiling point organic solvent are not easily mutually dissolved or mixed, direct contact between the polyamideimide resin and the aerogel may be minimized before the adiabatic coating composition of the exemplary embodiment is applied and dried, and the polyamideimide resin may be prevented from permeating the inside of the aerogel or the pore or being impregnated in the aerogel or the pore.

Specifically, a boiling point difference between the high boiling point organic solvent and the low boiling point organic solvent may be 10° C. or more, 20° C. or more, or 10 to 200° C. As the high boiling point organic solvent, an organic solvent having the boiling point of 110° C. or more may be used.

Specific examples of the high boiling point solvent may include anisole, toluene, xylene, methyl ethyl ketone, methyl isobutyl ketone, ethyleneglycol monomethylether, ethyleneglycol monoethylether, ethyleneglycol monobutylether, butyl acetate, cyclohexanone, ethyleneglycol monoethylether acetate (BCA), benzene, hexane, DMSO, N,N'-dimethylformamide, or a mixture of two or more kinds thereof.

As the low boiling point organic solvent, an organic solvent having the boiling point of less than 110° C. may be used.

Specific examples of the low boiling point organic solvent may include methyl alcohol, ethyl alcohol, propyl alcohol, n-butyl alcohol, iso-butyl alcohol, tert-butyl alcohol, acetone, methylene chloride, ethylene acetate, isopropyl alcohol, or a mixture of two or more kinds thereof.

Meanwhile, specific examples of the aqueous solvent may include water, methanol, ethanol, ethyl acetate, or a mixture of two or more kinds thereof.

On the other hand, according to another exemplary embodiment of the present invention, an adiabatic coating layer including a polyamideimide resin and an aerogel dispersed in the polyamideimide resin and having thermal conductivity of 0.60 W/m or less may be provided.

The present inventors manufactured the adiabatic coating layer, which could secure high mechanical properties and heat resistance while having low thermal conductivity and low density, and was applied to an internal combustion engine to reduce heat energy emitted to the outside and thus improve efficiency of the internal combustion engine and fuel efficiency of a vehicle, by using the aforementioned adiabatic coating composition of the exemplary embodiment.

In the adiabatic coating layer, the aerogel is uniformly dispersed over the entire region of the polyamideimide resin, and thus physical properties implemented from the aerogel, for example, low thermal conductivity and low density may be more easily secured, and a characteristic revealed from the polyamideimide resin, for example, high mechanical properties, heat resistance, and the like, may be implemented at the same level or more as the case where only the polyamideimide resin is used.

The adiabatic coating layer may have low thermal conductivity and the high thermal capacity, and specifically, the adiabatic coating layer may have thermal conductivity of 0.60 W/m or less, 0.55 W/m or less, or 0.60 W/m to 0.200 W/m, and the adiabatic coating layer may have the thermal capacity of 1,250 $KJ/m^3$ K or less or 1,000 to 1,250 $KJ/m^3$ K.

Meanwhile, as described above, since the adiabatic coating composition of the exemplary embodiment includes the polyamideimide resin dispersed in the high boiling point organic solvent or aqueous solvent and the aerogel dispersed in the low boiling point organic solvent, so that direct contact between the polyamideimide resin and the aerogel may be minimized before the coating composition is applied and dried, the polyamideimide resin may not permeate the inside of the aerogel or the pore included in the finally manufactured adiabatic coating layer or not be impregnated in the aerogel or the pore.

Specifically, the polyamideimide resin may not substantially exist in the aerogel dispersed in the polyamideimide resin, and for example, the polyamideimide resin may exist in a content of 2 wt % or less or 1 wt % or less in the aerogel.

Further, in the adiabatic coating layer, the aerogel may exist while being dispersed in the polyamideimide resin, and in this case, the outside of the aerogel may be in contact with or combined with the polyamideimide resin, but the polyamideimide resin may not exist in the aerogel. Specifically, the polyamideimide resin may not exist at a depth corresponding to 5% or more of a longest diameter from a surface of the aerogel included in the adiabatic coating layer.

Since the polyamideimide resin does not permeate the inside of the aerogel or the pore or is not impregnated in the aerogel or the pore, the aerogel may have the same level of porosity before and after the aerogel is dispersed in the polyamideimide resin, and specifically, each aerogel included in the adiabatic coating layer may have porosity of 92% to 99% while being dispersed in the polyamideimide resin.

The adiabatic coating layer of the exemplary embodiment may provide an adiabatic material, an adiabatic structure, and the like, which may be maintained over a long period of time in the internal combustion engine to which a repeated high temperature and high pressure condition is applied, and specifically, the adiabatic coating layer of the exemplary embodiment may be formed on the internal surface of the internal combustion engine or the intake valve that is a part of the internal combustion engine.

A thickness of the adiabatic coating layer of the exemplary embodiment may be determined according to an application field or position, or required physical properties, and for example, may be 50 μm to 500 μm.

The adiabatic coating layer of the exemplary embodiment may include the aerogel in a content of 5 to 50 parts by weight or 10 to 45 parts by weight based on 100 parts by weight of the polyamideimide resin.

If the content of the aerogel based on the polyamideimide resin is very small, it may be difficult to reduce thermal conductivity and density of the adiabatic coating layer, it may be difficult to secure a sufficient adiabatic property, and heat resistance of the adiabatic coating layer may be reduced. Further, if the content of the aerogel based on the polymer resin is very large, it may be difficult to sufficiently secure mechanical properties of the adiabatic coating layer, cracks of the adiabatic coating layer may be generated, or it may be difficult to maintain a strong coat form of the adiabatic membrane.

The polyamideimide resin may have a weight average molecular weight of 3,000 to 300,000 or 4,000 to 100,000.

The aerogel may include one or more kinds of compounds selected from the group consisting of silicon oxide, carbon, polyimide, and metal carbide.

The aerogel may have a specific surface area of 100 $cm^3/g$ to 1,000 $cm^3/g$.

A specific content of the polyamideimide resin and the aerogel includes the aforementioned content of the adiabatic coating composition of the exemplary embodiment.

Meanwhile, the adiabatic coating layer of the exemplary embodiment may be obtained by drying the adiabatic coating composition of the exemplary embodiment. A device or a method, which may be used in drying the adiabatic coating composition of the exemplary embodiment, is not largely limited, and a spontaneous drying method at a temperature of room temperature or more, a drying method of heating to a temperature of 50° C. or more, or the like may be used.

For example, the adiabatic coating composition of the exemplary embodiment may be applied on a coating target, for example, the internal surface of the internal combustion engine or an external surface of a part of the internal combustion engine, and semi-dried at a temperature of 50° C. to 200° C. one or more times, and the semi-dried coating composition may be completely dried at a temperature of 200° C. or more to form the adiabatic coating layer. However, a specific manufacturing method of the adiabatic coating layer of the exemplary embodiment is not limited thereto.

The present invention will be described in more detail in the following Examples. However, the following Examples are set forth to illustrate the present invention, but the content of the present invention is not limited by the following Examples.

EXAMPLES 1 TO 3

(1) Manufacturing of Adiabatic Coating Composition

The porous silica aerogel (specific surface area: about 500 $cm^3/g$) dispersed in ethyl alcohol and the polyamideimide resin (products manufactured by Solvay SA, weight average molecular weight: about 11,000) dispersed in xylene were injected into the 20 g reactor, the zirconia bead was added thereto (440 g), and ball milling was performed under the room temperature and normal pressure condition at the speed of 150 to 300 rpm to manufacture the adiabatic coating composition (coating solution).

In this case, the weight ratio of the porous silica aerogel based on the polyamideimide resin is described in the following Table 1.

(2) Forming of Adiabatic Coating Layer

The obtained adiabatic coating composition was applied on a part for a vehicle engine by a spray coating method. In addition, the adiabatic coating composition was applied on the part, primary semi-drying was performed at about 150° C. for about 10 minutes, the adiabatic coating composition was re-applied, and secondary semi-drying was performed at about 150° C. for about 10 minutes. After the secondary semi-drying, the adiabatic coating composition was applied again, and complete drying was performed at about 250° C. for about 60 minutes to form the adiabatic coating layer on the part. In this case, the thickness of the formed coating layer is described in the following Table 1.

COMPARATIVE EXAMPLE 1

The solution (PAI solution) of the polyamideimide resin (products manufactured by Solvay SA, weight average molecular weight: about 11,000) dispersed in xylene was applied on a part for a vehicle engine by the spray coating method.

In addition, the PAI solution was applied on the part, primary semi-drying was performed at about 150° C. for about 10 minutes, the PAI solution was re-applied, and secondary semi-drying was performed at about 150° C. for about 10 minutes. After the secondary semi-drying, the PAI solution was applied again, and complete drying was performed at about 250° C. for about 60 minutes to form the adiabatic coating layer on the part. In this case, the thickness of the formed coating layer is described in the following Table 1.

COMPARATIVE EXAMPLE 2

(1) Manufacturing of Coating Composition

The porous silica aerogel (specific surface area: about 500 $cm^3/g$) and the polyamideimide resin (products manufactured by Solvay SA, weight average molecular weight: about 11,000) dispersed in xylene were injected into the 20 g reactor, the zirconia bead was added thereto (440 g), and ball milling was performed under the room temperature and normal pressure condition at the speed of 150 to 300 rpm to manufacture the coating composition (coating solution).

In this case, the weight ratio of the porous silica aerogel based on the polyamideimide resin is described in the following Table 1.

(2) Forming of Adiabatic Coating Layer

The coating layer having the thickness of about 200 μm was formed by the same method as Example 1.

EXPERIMENTAL EXAMPLE

1. Experimental Example 1 : Measurement of Thermal Conductivity

Thermal conductivity of the coating layers on the parts obtained in the Examples and the Comparative Examples was measured on the basis of ASTM E1461 under the room temperature and normal pressure condition using the laser flash method by the thermal diffusion measuring method.

2 . Experimental Example 2 : Measurement of Thermal Capacity

The thermal capacity was confirmed by measuring specific heat of the coating layers on the parts obtained in the Examples and the Comparative Examples on the basis of ASTM E1269 under the room temperature condition using the DSC device and using sapphire as a reference.

TABLE 1

| | Content of aerogel based on 100 parts by weight of PAI resin (parts by weight) | Thickness of coating layer (μm) | Thermal conductivity of coating layer [W/m] | Thermal capacity of coating layer [$KJ/m^3$ K] |
|---|---|---|---|---|
| Example 1 | 15 | 120 | 0.54 | 1216 |
| Example 2 | 20 | 200 | 0.331 | 1240 |
| Example 3 | 40 | 200 | 0.294 | 1124 |
| Comparative Example 1 | — | 200 | 0.56 | 1221 |

As described in Table 1, it was confirmed that the adiabatic coating layers obtained in Examples 1 to 3 had the thermal capacity of 1240 $KJ/m^3$ K or less and thermal conductivity of 0.54 W/m or less in the thickness of 120 to 200 μm. Accordingly, the adiabatic coating layers obtained in Examples 1 to 3 may be applied to coating of the parts of the internal combustion engine to reduce heat energy emitted to the outside and thus improve efficiency of the internal combustion engine and fuel efficiency of the vehicle.

Figure 2:
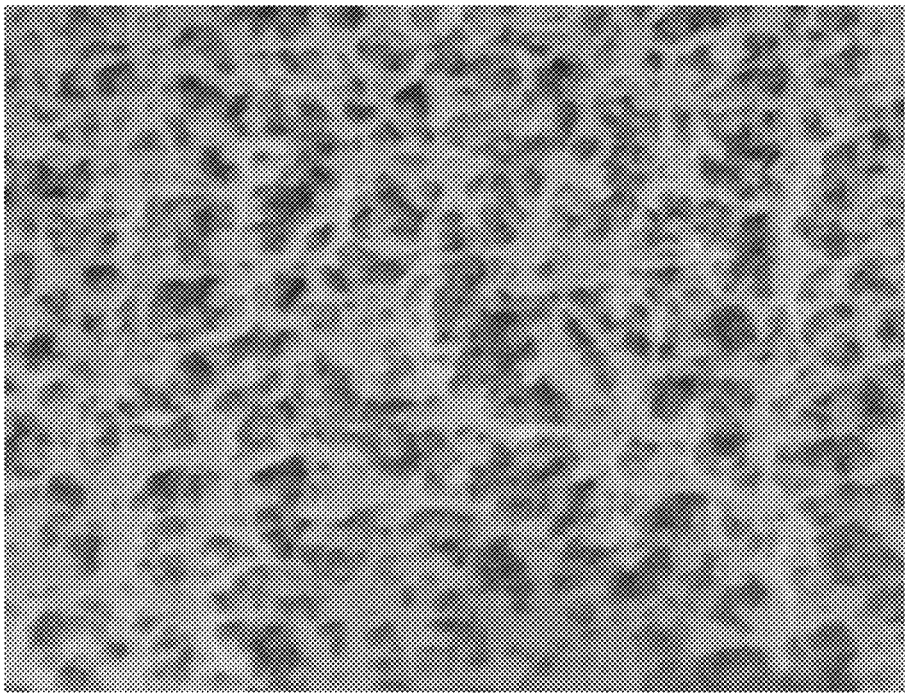
FIG. 2 is a picture illustrating a surface of an adiabatic coating layer obtained in the exemplary embodiment of the present invention.

Further, as illustrated in FIG. 2, it can be confirmed that in the adiabatic coating layer manufactured in Example 1, the polyamideimide resin does not permeate the inside of the aerogel and almost 92% or more of the pores in the aerogel are maintained.

Figure 3:
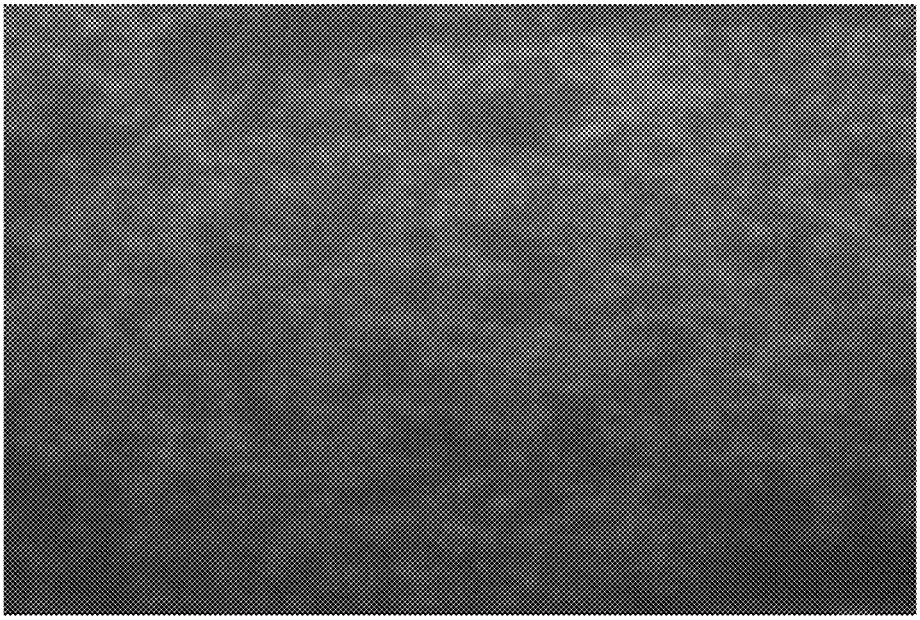
FIG. 3 is a picture illustrating a surface of a coating layer obtained in a Comparative Example as compared to the exemplary embodiment of the present invention.

On the other hand, in the coating layer manufactured in Comparative Example 2, as illustrated in FIG. 3, the polyamideimide resin permeated the inside of the aerogel, and thus the pores were hardly observed.

According to the aforementioned exhaust valve 100 for the engine according to the exemplary embodiment of the present invention, it is possible to block heat absorption, promote a reduction in cooling loss (heat loss) by the adiabatic effect, and improve efficiency of the engine and fuel efficiency of the vehicle by applying the adiabatic coating layer capable of securing high mechanical properties and heat resistance while having low thermal conductivity and the low volumetric heat capacity.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An intake valve for an engine, which supplies an intake gas to a combustion chamber of the engine, comprising:

an adiabatic coating layer including a mixture of a polyamideimide resin and a silica aerogel, the silica aerogel being dispersed in the polyamideimide resin, and having thermal conductivity of 0.60 W/m or less is formed on a surface portion of the intake valve configured to come into contact with a flame, wherein the adiabatic coating layer is obtained from the adiabatic coating composition including the polyamideimide resin dispersed in a high boiling point organic solvent or an aqueous solvent and the aerogel dispersed in a low boiling point organic solvent, the polyamideimide resin does not exist at a depth corresponding to 5% or more of a longest diameter from a surface of the silica aerogel, the polyamideimide resin exists in a content of 2 wt % or less in the silica aerogel, the adiabatic coating layer includes 5 to 50 parts by weight of the silica aerogel based on 100 parts by weight of the polyamideimide resin, and each of the silica aerogel has a porosity of 92% to 99% while being dispersed in the polyamideimide resin.

2. The intake valve of claim 1, wherein:

the adiabatic coating layer has a thermal capacity of 1,250 $KJ/m^3$ K or less.

3. The intake valve of claim 1, wherein:

the adiabatic coating layer has a thickness of 50 μm to 500 μm.

4. An intake valve for an engine, which supplies an intake gas to a combustion chamber of the engine, comprising:

an adiabatic coating layer including a mixture of a polyamideimide resin and a silica aerogel, the silica aerogel being dispersed in the polyamideimide resin, and having thermal conductivity of 0.60 W/m or less is formed on a neck portion of the intake valve configured to come into contact with the intake gas, wherein the adiabatic coating layer is obtained from the adiabatic coating compositon including the polyamideimide resin dispersed in a high boiling point organic solvent or an aqueous solvent and the aerogel dispersed in a low boiling point organic solvent, the polyamideimide resin does not exist at a depth corresponding to 5% or more of a longest diameter from a surface of the silica aerogel, the polyamideimide resin exists in a content of 2 wt % or less in the silica aerogel, the adiabatic coating layer includes 5 to 50 parts by weight of the silica aerogel based on 100 parts by weight of the polyamideimide resin, and each of the silica aerogel has a porosity of 92% to 99% while being dispersed in the polyamideimide resin.

5. The intake valve of claim 4, wherein:

the adiabatic coating layer has a thermal capacity of 1,250 $KJ/m^3$ K or less.

6. The intake valve of claim 4, wherein:

the adiabatic coating layer has a thickness of 50 μm to 500 μm.

7. An intake valve for an engine, which supplies an intake gas to a combustion chamber of the engine, comprising:

an adiabatic coating layer including a mixture of a polyamideimide resin and a silica aerogel, the silica aerogel being dispersed in the polyamideimide resin, and having thermal conductivity of 0.60 W/m or less is formed on a surface portion of the intake valve configured to come into contact with a flame and a neck portion configured to come into contact with the intake gas, wherein the adiabatic coating layer is obtained from the adiabatic coating composition including the polyamideimide resin dispersed in a high boiling point organic solvent or an aqueous solvent and the aerogel dispersed in a low boiling point organic solvent, the polyamideimide resin does not exist at a depth corresponding to 5% or more of a longest diameter from a surface of the silica aerogel, the polyamideimide resin exists in a content of 2 wt % or less in the silica aerogel, the adiabatic coating layer includes 5 to 50 parts by weight of the silica aerogel based on 100 parts by weight of the polyamideimide resin, and each of the silica aerogel has a porosity of 92% to 99% while being dispersed in the polyamideimide resin.

8. The intake valve of claim 7, wherein:

the adiabatic coating layer has a thermal capacity of 1,250 $KJ/m^3$ K or less.

9. The intake valve of claim 7, wherein:

the adiabatic coating layer has a thickness of 50 μm to 500 μm.

* * * * *